US006360570B1

(12) United States Patent
Shen

(10) Patent No.: US 6,360,570 B1
(45) Date of Patent: Mar. 26, 2002

(54) LOCKSET KNOB ASSEMBLY FOR USE WITH AN INTERCHANGEABLE LOCK CORE

(76) Inventor: Mu-Lin Shen, No. 32, Lane 76, Fu-An Road, Sec. 5, Tainan (TW)

( * ) Notice: Subject to any disclaimer, the term of this patent is extended or adjusted under 35 U.S.C. 154(b) by 0 days.

(21) Appl. No.: 09/638,696

(22) Filed: Aug. 14, 2000

(51) Int. Cl.[7] ..... E05B 9/04; E05B 13/10
(52) U.S. Cl. ..... 70/224; 70/369; 70/371
(58) Field of Search ..... 70/224, 370, 371, 70/367–369, DIG. 39, 451, 207, 215–217, 221, 372, 466

(56) References Cited

U.S. PATENT DOCUMENTS

| | | | | | |
|---|---|---|---|---|---|
| 3,308,641 | A | * | 3/1967 | Russell et al. | 70/224 |
| 3,869,890 | A | * | 3/1975 | Neary | 70/451 |
| 4,435,967 | A | * | 3/1984 | Best et al. | 70/224 |
| 4,995,249 | A | * | 2/1991 | Preissler et al. | 70/224 |
| 5,398,531 | A | * | 3/1995 | Shen | 70/369 X |
| 5,507,163 | A | * | 4/1996 | Juang | 70/369 |
| 6,014,877 | A | * | 1/2000 | Shen | 70/369 X |
| 6,112,565 | A | * | 9/2000 | Aramburu | 70/368 X |

* cited by examiner

*Primary Examiner*—Lloyd A. Gall

(74) *Attorney, Agent, or Firm*—Alan Kamrath; Rider, Bennett, Egan & Arundel, LLP

(57) ABSTRACT

A lockset knob assembly comprises an outer knob housing, an inner knob housing, a spindle, and a sleeve. The outer knob housing includes a first end with a first opening and a second end with a first 8-shape hole. A periphery defining the first 8-shape hole includes a retaining flange projecting inward toward the first end of the outer knob housing. The inner knob housing includes a first end with a second opening and a second end with a second 8-shape hole in an end face of the second end. The second 8-shape hole is larger than the first 8-shape hole. The inner knob housing is mounted in the outer knob housing with the retaining flange of the outer knob housing engaged in the second 8-shape hole to thereby preventing relative movement between the inner knob housing and the outer knob housing. The inner knob housing further including a number of slots and a number of radially extending grooves, each groove being adjacent to and communicated with an associated slot. The spindle includes a number of longitudinal projections that are extended through the slots of the inner knob housing and then bent so as to be positioned in the grooves of the inner knob housing, respectively, the spindle further including a first engaging portion. The sleeve is mounted in the spindle and includes a second engaging portion that is engaged with the first engaging portion, thereby preventing longitudinal movement and rotational movement of the sleeve relative to the spindle.

3 Claims, 4 Drawing Sheets

LOCKSET KNOB ASSEMBLY FOR USE WITH AN INTERCHANGEABLE LOCK CORE

BACKGROUND OF THE INVENTION

1. Field of the Invention

The present invention relates to a lockset knob assembly for use with an interchangeable lock core.

2. Description of the Related Art

Locks allowing interchanging of lock cores have been used, and two typical types thereof include knobs and lever handles for receiving the interchangeable lock cores. FIGS. 5 through 7 of the drawings illustrates a conventional lockset knob assembly for use with an to interchangeable lock core. The lockset knob assembly includes an outer knob housing 80, an inner knob housing 81, a sleeve 82, and a spindle 83 that is operably connected with a transmission shaft of a lockset transmission assembly. The lockset is unlatched when the spindle 83 is turned. The sleeve 82 is mounted in the spindle 83 and includes a number of inner radial protrusions 831 for positioning the sleeve 82. As illustrated in FIGS. 5 and 6, the spindle 83 includes a number of longitudinal projections 832 that are extended through associated slots 811 in the inner knob housing 81 and then bent so as to be positioned in associated grooves 812 in the inner knob housing 81. As illustrated in FIGS. 5 and 6, the inner knob housing 81 is inserted into the outer knob housing 80 via an opening in an end of the outer knob housing 80 with an 8-shape hole 813 in an end face of the inner knob housing 81 aligned with an 8-shape hole 802 in an end face of the outer knob housing 80. Then, the outer knob housing 80 is rolled to reduce the diameter of the opening 801, thereby enclosing the inner knob housing 81.

After mounting a lock core 84 via the 8-shape holes 813 and 802, a proper key is inserted into the lock core 84 and then rotated through a pre-determined angle to make a wing 841 project outward and be located behind the sleeve 82, thereby preventing disengagement of the lock core 84. Replacement of the lock core 84 can be easily achieved by means of inserting the proper key into the lock core 84 and rotating the key through the pre-determined angle in a reverse direction until the wing 841 retracts into the lock core 84 to thereby allow removal of the lock core 84 and subsequent insertion of a new lock core.

Nevertheless, when removing the lock core 84, the sleeve 82 may be rotated inadvertently and thus hinder insertion of the new lock core, as a central portion of the sleeve 82 no longer aligns with a lower portion of the 8-shape hole 813 of the inner knob housing 81. In addition, since the inner knob housing 81 and the outer knob housing 80 are not positioned relative to each other, the inner knob housing 81 and the outer knob housing 80 may be moved relative to each other during rolling of the outer knob housing 80, such that the 8-shape holes 813 and 802 thereof no longer align with each other. Additional adjustment for re-achieving the alignment of the 8-shape holes 813 and 802 is required. Furthermore, the inner and outer knob housings 80 and 81 are formed by means of punching and rolling thin metal plates and are thus very thin, especially in the 8-shape holes 802 and 813. As a result, even though a lock core 84 is mounted in the 8-shape holes 802 and 813, the lockset can be picked easily by means of inserting a sharp article through a point A in FIG. 6 to damage the outer end face of the outer knob housing 80 and then the lock core 84 and the inner knob housing 81.

SUMMARY OF THE INVENTION

A lockset knob assembly in accordance with the present invention comprises:

an outer knob housing including a first end with a first opening and a second end with a first 8-shape hole in an end face of the second end, a periphery defining the first 8-shape hole including a retaining flange projecting inward toward the first end of the outer knob housing;

an inner knob housing including a first end with a second opening and a second end with a second 8-shape hole in an end face of the second end, the second 8-shape hole being larger than the first 8-shape hole, the inner knob housing being mounted in the outer knob housing with the retaining flange of the outer knob housing engaged in the second 8-shape hole to thereby prevent relative movement between the inner knob housing and the outer knob housing, the inner knob housing further including a plurality of slots and a plurality of radially extending grooves, each said groove being adjacent to and communicated with an associated said slot;

a spindle including a plurality of longitudinal projections that are extended through the slots of the inner knob housing and then bent so as to be positioned in the grooves of the inner knob housing, respectively, the spindle further including a first engaging portion; and a sleeve mounted in the spindle and including a second engaging portion that is engaged with the first engaging portion, thereby preventing longitudinal movement and rotational movement of the sleeve relative to the spindle.

The first engaging portion is a protrusion and the second engaging portion is an engaging slot for engaging with the protrusion. Alternatively, the first engaging portion is an engaging slot and the second engaging portion is a protrusion for engaging with the engaging slot.

In accordance with the present invention, the sleeve of the lockset knob assembly is reliably positioned so as not to interfere with changing of the lock core. The retaining flange that projects inward from a periphery defining the 8-shape hole of the outer knob housing engages with a periphery defining the 8-shape hole of the inner knob housing to thereby prevent relative movement between the inner knob housing and the outer knob housing during the rolling procedure for enclosing the inner knob housing by the outer knob housing. In addition, the thickness of the periphery defining the 8-shape hole of the outer knob housing is increased and the strength thereof is improved to prevent picking of and damage to the lockset.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
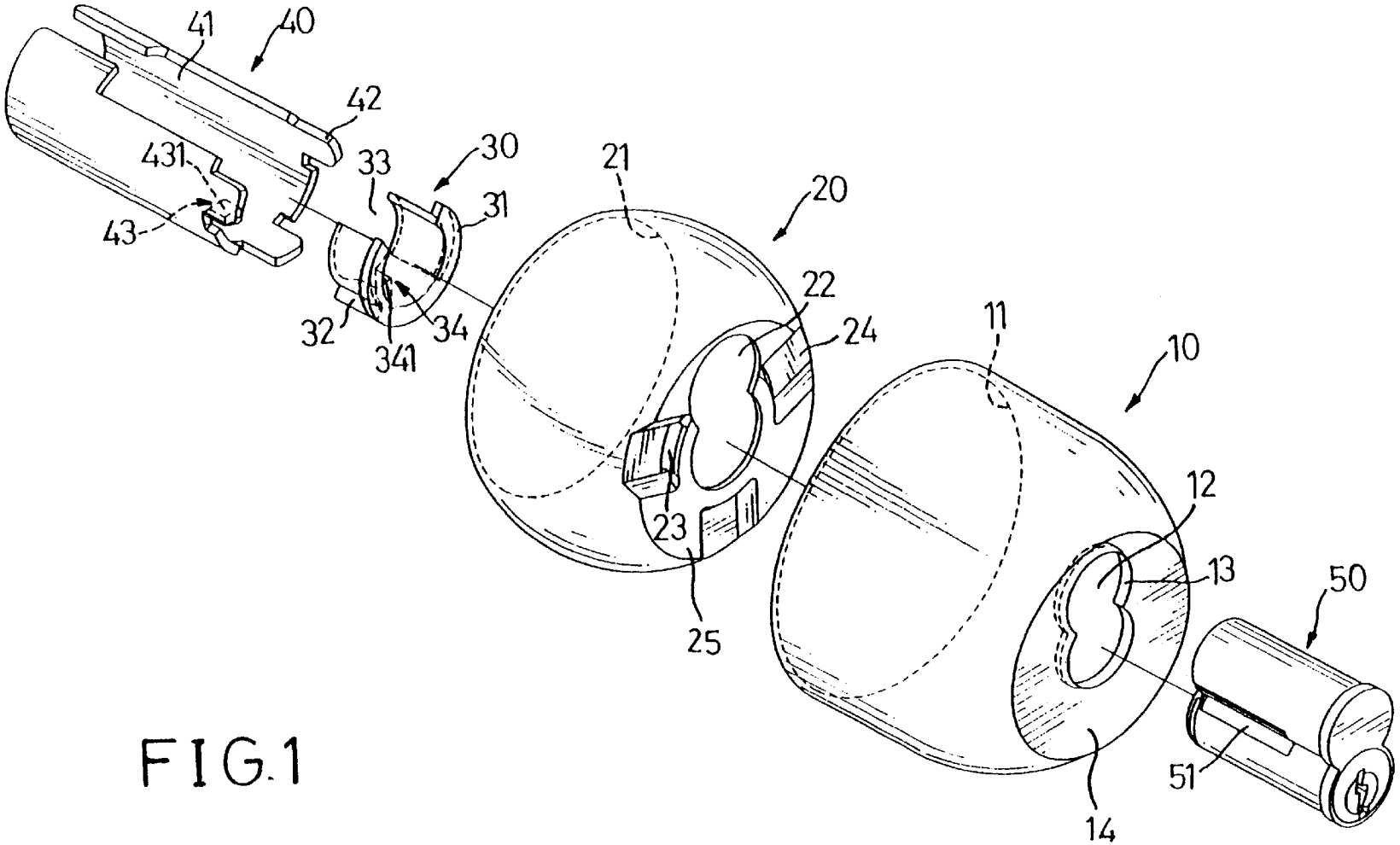
FIG. 1 is an exploded perspective view of a lockset knob assembly in accordance with the present invention.
Figure 4:
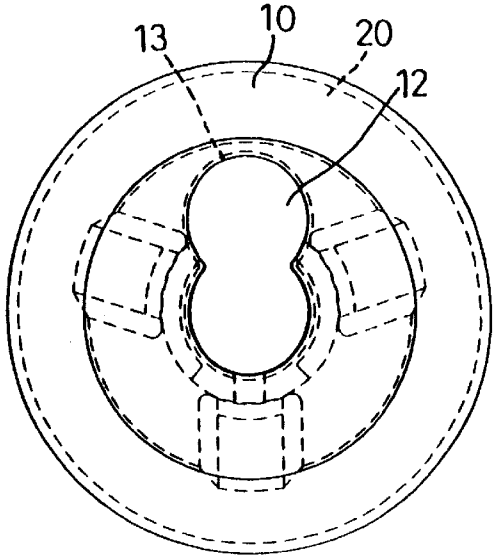
FIG. 4 is a front elevational view of the lockset knob housing in accordance with the present invention.
Figure 3:
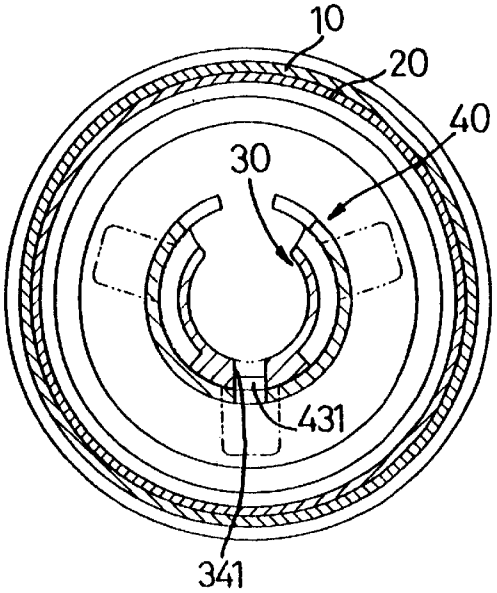
FIG. 3 is a sectional view taken along line 3—3 in FIG. 2.
Figure 2:
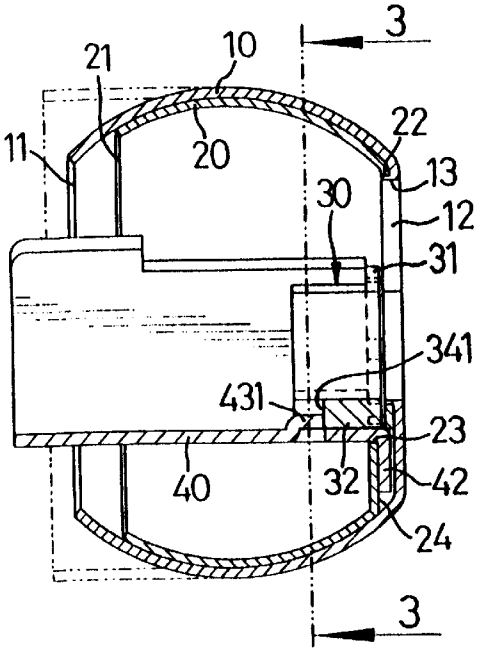
FIG. 2 is a sectional view of the lockset knob housing in accordance with the present invention.
Figure 5:
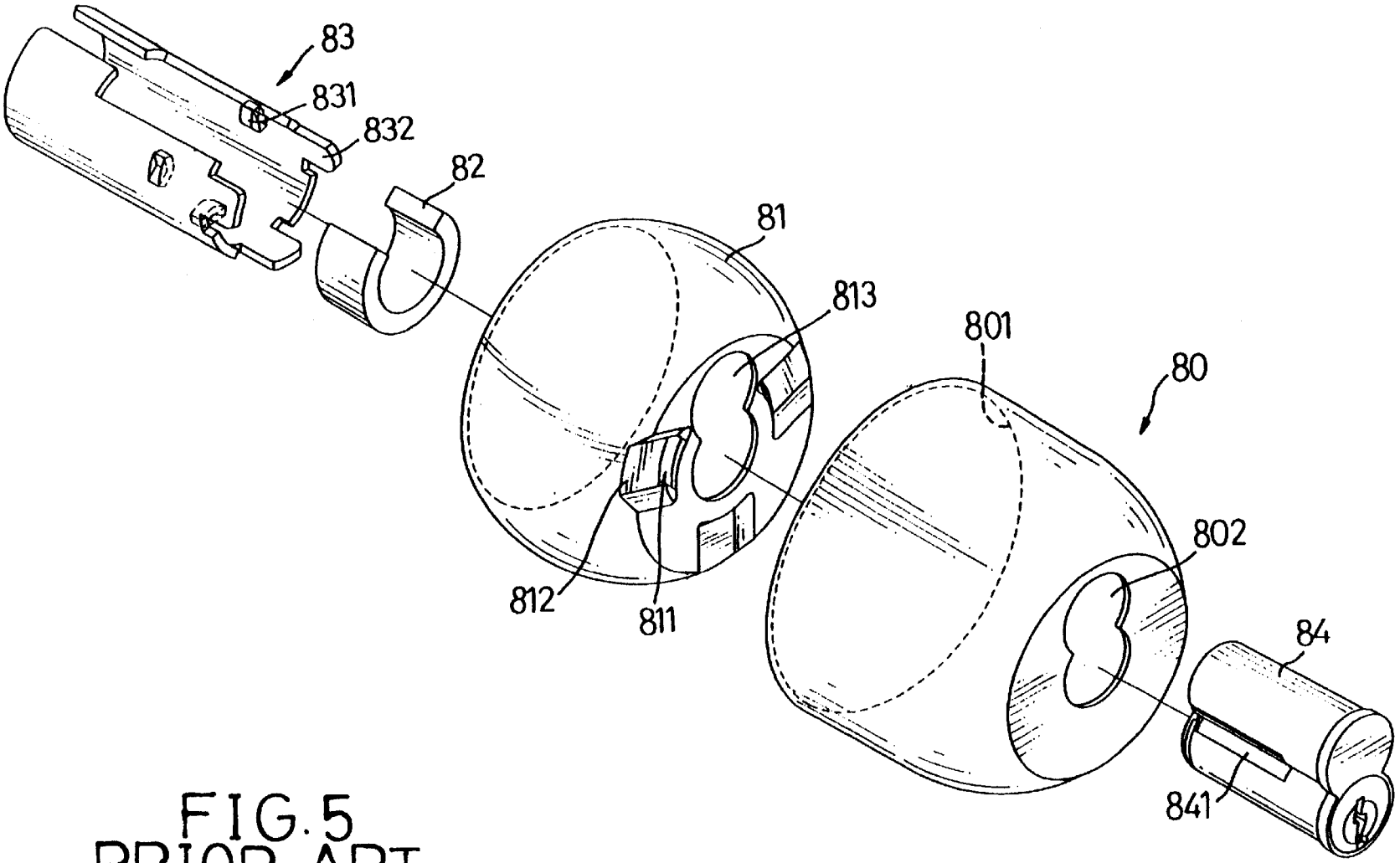
FIG. 5 PRIOR ART
FIG. 5 is an exploded perspective view of a conventional lockset knob assembly.
Figure 7:
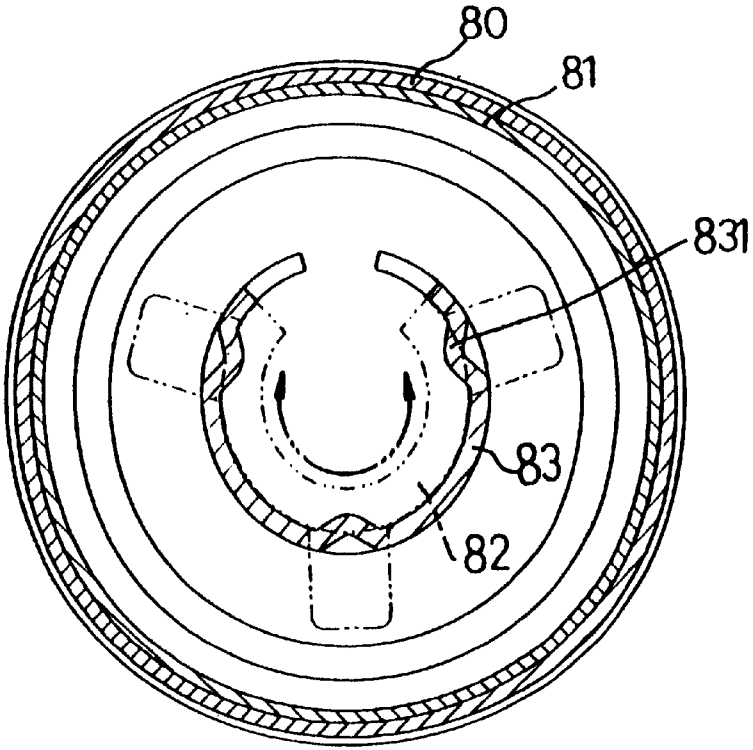
FIG. 7 PRIOR ART
FIG. 7 is a sectional view taken along line 7—7 in FIG. 6.
Figure 6:
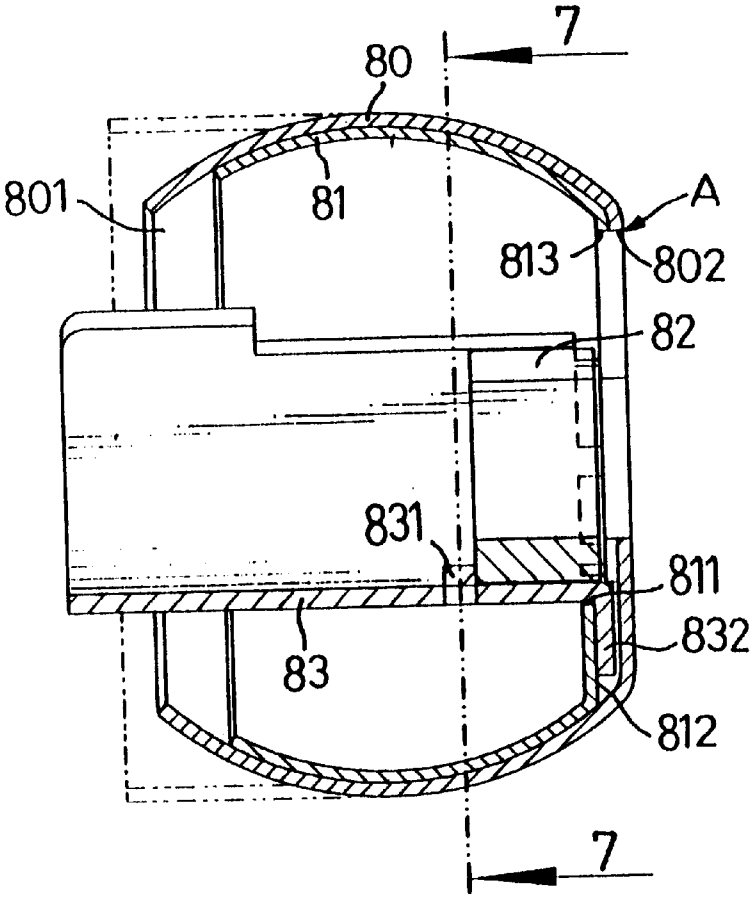
FIG. 6 PRIOR ART
FIG. 6 is a sectional view of the conventional lockset knob housing.

Referring to FIGS. 1 through 4 and particularly to FIG. 1, a lockset knob assembly in accordance with the present invention generally includes an outer knob housing 10, an inner knob housing 20, a sleeve 30, and spindle 40. The inner knob housing 20 is formed by punching and then rolling to present a form shown in FIG. 1. The outer knob housing 10 includes a first end with an opening 11 and a second end with an 8-shape opening 12 in an end face 14 thereof. As illustrated in FIG. 2, a periphery defining the 8-shape opening 12 includes a retaining flange 13 that projecting inward therefrom (namely, toward the first end of the outer knob housing 10).

The inner knob housing 20 has a volume smaller than that of the outer knob housing 10 and includes a first end with an opening 21 and a second end with an 8-shape hole 22 in an end face 25 thereof. The 8-shape hole 22 of the inner knob housing 20 is larger than the 8-shape hole 12 of the outer knob housing 10 such that the retaining flange 13 is extended into the 8-shape hole 22 of the inner knob housing 20 when the inner knob housing 20 is mounted into the outer knob housing 10, thereby preventing relative movement between the inner knob housing 20 and the outer knob housing 10. The inner knob housing 20 further includes a number of slots 23 and a plurality of grooves 24. Each groove 24 extends radially outward and is adjacent to and communicated with each slot 23, best shown in FIG. 2.

The sleeve 30 includes a flange 31 in an end thereof and a sector wing 32 on an outer periphery thereof. A slot 33 is defined in the outer periphery of the sleeve 30 and located at a position opposite to the sector wing 32. The sleeve 30 further includes an engaging portion 34 in the form of an engaging slot 341 shown in FIG. 1 or a protrusion.

The spindle 40 includes a number of longitudinal projections 42 that are extended through the associated slots 23 in the inner knob housing 20 and then bent so as to be positioned in the associated grooves 24 in the inner knob housing 20. The spindle 40 further includes an engaging portion 43 in the form of a protrusion 431 shown in FIG. 1 or an engaging slot for engaging with the engaging portion 34 of the sleeve 30.

In assembly, referring to FIGS. 1 and 2, the sleeve 30 is mounted into the spindle 40 with the engaging portion 34 engaged with the engaging portion 43. Thus, rotational movement and longitudinal of the sleeve 30 relative to the spindle 40 are both prevented. Next, the longitudinal projections 42 of the spindle 40 are extended through the slots 23 in the inner knob housing 20 and then bent so as to be positioned in the associated grooves 24 in the inner knob housing 20. Thus, the sleeve 30 is sandwiched between the inner knob housing 20 and the spindle 40 with a central portion of the sleeve 30 aligned with a lower portion of the 8-shape hole 22 of the inner knob housing 20. Then, the outer knob housing 10 is mounted around the inner knob housing 20 via the opening 11 with the retaining flange 13 of the outer knob housing 10 positioned in the 8-shape hole 22 of the inner knob housing 20, best shown in FIGS. 2 and 4. Thus, relative movement between the outer knob housing 10 and the inner knob housing 20 is avoided during rolling of the outer knob housing 10. As a result, the 8-shape hole 12 of the outer knob housing 10 is always aligned with the 8-shape hole 22 of the inner knob housing 20.

After mounting a lock core 50 via the 8-shape holes 12 and 22, a proper key is inserted into the lock core 50 and then rotated through a pre-determined angle to make a wing 51 project outward and be located behind the sleeve 30, thereby preventing disengagement of the lock core 50. Replacement of the lock core 50 can be easily achieved by means of inserting the proper key into the lock core 50 and rotating the key through the pre-determined angle in a reverse direction until the wing 51 retracts into the lock core 50 to thereby allow removal of the lock core 50 and subsequent insertion of a new lock core.

According to the above description, the sleeve 30 of the lockset knob assembly is reliably positioned so as not to interfere with changing of the lock core 50. The retaining flange 13 that projects inward from a periphery defining the 8-shape hole 12 of the outer knob housing 10 engages with a periphery defining the 8-shape hole 22 of the inner knob housing 20 to thereby prevent relative movement between the inner knob housing 20 and the outer knob housing 10 during the rolling procedure for enclosing the inner knob housing 20 by the outer knob housing 10. In addition, the thickness of the periphery defining the 8-shape hole 12 of the outer knob housing 10 is increased and the strength thereof is improved to prevent picking of and damage to the lockset.

Although the invention has been explained in relation to its preferred embodiment, it is to be understood that many other possible modifications and variations can be made without departing from the scope of the invention as hereinafter claimed.

What is claimed is:

1. A lockset knob assembly comprising:

an outer knob housing including a first end with a first opening and a second end with a first 8-shape hole in an end face of the second end, a periphery defining the first 8-shape hole including a retaining flange projecting inward toward the first end of the outer knob housing;

an inner knob housing including a first end with a second opening and a second end with a second 8-shape hole in an end face of the second end, the second 8-shape hole being larger than the first 8-shape hole, the inner knob housing being mounted in the outer knob housing with the retaining flange of the outer knob housing engaged in the second 8-shape hole to thereby preventing relative movement between the inner knob housing and the outer knob housing, the inner knob housing further including a plurality of slots and a plurality of radially extending grooves, each said groove being adjacent to and communicated with an associated said slot;

a spindle including a plurality of longitudinal projections that are extended through the slots of the inner knob housing and then bent so as to be positioned in the grooves of the inner knob housing, respectively, the spindle further including a first engaging portion; and a sleeve mounted in the spindle and including a second engaging portion that is engaged with the first engaging portion, thereby preventing longitudinal movement and rotational movement of the sleeve relative to the spindle.

2. The lockset knob assembly as claimed in claim 1, wherein the first engaging portion is a protrusion and the second engaging portion is an engaging slot for engaging with the protrusion.

3. The lockset knob assembly as claimed in claim 1, wherein the first engaging portion is an engaging slot and the second engaging portion is a protrusion for engaging with the engaging slot.

* * * * *